US008358252B2

(12) United States Patent
Mori

(10) Patent No.: US 8,358,252 B2
(45) Date of Patent: Jan. 22, 2013

(54) ANTENNA

(75) Inventor: Nobuyuki Mori, Tokyo (JP)

(73) Assignee: Sony Corporation (JP)

( * ) Notice: Subject to any disclaimer, the term of this patent is extended or adjusted under 35 U.S.C. 154(b) by 403 days.

(21) Appl. No.: 12/658,888

(22) Filed: Feb. 17, 2010

(65) Prior Publication Data

US 2010/0220027 A1 Sep. 2, 2010

(30) Foreign Application Priority Data

Feb. 27, 2009 (JP) ..... P2009-045194

(51) Int. Cl.
*H01Q 19/10* (2006.01)

(52) U.S. Cl. ..... 343/818

(58) Field of Classification Search ..... 343/818, 343/815, 817, 834
See application file for complete search history.

(56) References Cited

U.S. PATENT DOCUMENTS

| | | | | |
|---|---|---|---|---|
| 6,008,773 | A * | 12/1999 | Matsuoka et al. | 343/818 |
| 6,515,634 | B2 * | 2/2003 | Desclos et al. | 343/818 |
| 7,193,574 | B2 * | 3/2007 | Chiang et al. | 343/757 |
| 7,388,543 | B2 * | 6/2008 | Vance | 343/700 MS |
| 7,495,620 | B2 * | 2/2009 | Wang et al. | 343/702 |
| 7,728,785 | B2 * | 6/2010 | Ozden | 343/866 |
| 7,817,103 | B2 * | 10/2010 | Kersten et al. | 343/895 |
| 2005/0088358 | A1 * | 4/2005 | Larry et al. | 343/833 |

FOREIGN PATENT DOCUMENTS

| | | | |
|---|---|---|---|
| JP | 58068704 | A | 4/1983 |
| JP | 60129708 | A | 7/1985 |
| JP | 2000-315909 | A | 11/2000 |
| JP | 2001-185947 | A | 7/2001 |
| JP | 2001244731 | A | 9/2001 |
| JP | 2007202040 | A | 8/2007 |
| JP | 2007228601 | A | 9/2007 |
| JP | 2008-131332 | A | 6/2008 |
| WO | 2009011041 | A1 | 1/2009 |

OTHER PUBLICATIONS

Office Action from Japanese Application No. 2009-045194, dated Jun. 21, 2011.
Office Action from Japanese Application No. 2009-045194, dated Jan. 18, 2011.

* cited by examiner

*Primary Examiner* — Huedung Mancuso
(74) *Attorney, Agent, or Firm* — Lerner, David, Littenberg, Krumholz & Mentlik, LLP

(57) ABSTRACT

An antenna includes: a dipole antenna; and a parasitic element arranged in parallel to the dipole antenna and having a linear structure and a meander structure, wherein a directivity and a return loss of the dipole antenna are controlled by setting a distance between the dipole antenna and the parasitic element and a shape and size of the meander structure.

4 Claims, 12 Drawing Sheets

ANTENNA

CROSS-REFERENCE TO RELATED APPLICATION

The present application claims priority from Japanese Patent Application No. JP 2009-045194 filed in the Japanese Patent Office on Feb. 27, 2009, the entire content of which is incorporated herein by reference.

BACKGROUND OF THE INVENTION

1. Field of the Invention

The present invention relates to an antenna to be adapted to an antenna which is used in, for example, wireless LAN.

2. Description of the Related Art

A dipole antenna is non-directional in a horizontal plane. While non-directivity has an advantage of ensuring radiation in all the directions on a horizontal plane, it raises a problem of making it difficult to set an electric scatterer nearby. If an electric scatterer (a metal body, any other dielectric substance or the like) overlaps the peripheral portion of the antenna where the radiation level is high, electromagnetic coupling causes a current which should originally flow to the antenna to flow toward the electric scatterer. This results in deteriorations of the antenna characteristics, such as shifting of the resonance frequency of the antenna and reduction in the radiation efficiency of the antenna.

Recently, there is a need for a built-in dipole antenna from viewpoints of making devices compact and the design. The incorporation of an antenna allows a metal casing, a metal heat sink, a printed wiring board or the like to be positioned close to the antenna, leading to the aforementioned deteriorations of the antenna characteristics.

Possible solutions to this problem include increasing the distance between the antenna and the radio scatterer, and insertion of a radio absorber between the antenna and the radio scatterer. The method of increasing the distance hinders miniaturization of the whole antenna, and the insertion of the radio absorber stands in the way of reducing the cost. To incorporate a dipole antenna in a smaller space in a radio device at a lower cost, it is desirable to control the directivity of the antenna to spatially avoid the nearby radio scatterer.

As one way of controlling the directivity of an antenna, controlling the antenna directivity by using a linear parasitic element has been proposed (see JP-A-2001-185947(Patent Document 1)). The antenna described in Patent Document 1 has a common dipole 5 having a full length of $\lambda/2$ ($\lambda$: wavelength corresponding to the transmission frequency), shown in FIG. 1A. Further, linear parasitic elements $\mathbf{6}_1$ to $\mathbf{6}_n$ each having a length of $\lambda/2$ are disposed at positions separate from the axis of the common dipole 5 by a distance D2 so as to enclose the common dipole 5. The linear parasitic elements $\mathbf{6}_1$ to $\mathbf{6}_n$ each have a cross section of a radius D1.

A U-shaped parasitic element 7 is disposed in close vicinity of one end of the common dipole 5. The U-shaped parasitic element 7 includes a bottom portion 7*a* formed of a cylindrical conductor having a radius D3 and a length L3, and two arm portions 7*b* each formed of a cylindrical conductor having the radius D3 and a length L2. The U-shaped parasitic element 7 serves to match the impedance of the common dipole 5 with the impedance of the linear parasitic elements.

The electromagnetic wave from the common dipole 5 induces a resonance current in the linear parasitic elements $\mathbf{6}_1$ to $\mathbf{6}_n$, so that the electromagnetic waves radiated from the linear parasitic elements $\mathbf{6}_1$ to $\mathbf{6}_n$ are combined with the electromagnetic wave radiated from the common dipole 5 to change the radiation directivity.

SUMMARY OF THE INVENTION

Even equipped with just one of the linear parasitic elements $\mathbf{6}_1$ to $\mathbf{6}_n$, because of the provision of the U-shaped parasitic element 7, the antenna described in Patent Document 1 inevitably has a stereo (three-dimensional) arrangement of the common dipole 5 and the U-shaped parasitic element 7. This prevents the antenna from having a planar (two-dimensional) structure. The fact that the planar structure cannot be adopted hinders the miniaturization of the antenna and the formation of the antenna on a printed wiring board, which would otherwise lead to cost reduction.

It is therefore desirable to provide a compact and low-cost antenna whose directivity is controllable.

According to an embodiment of the present invention, there is provided an antenna including a dipole antenna, and a parasitic element arranged in parallel to the dipole antenna and having a linear structure and a meander structure, wherein a directivity and a return loss of the dipole antenna are controlled by setting a distance between the dipole antenna and the parasitic element and a shape and size of the meander structure.

According to another embodiment of the invention, there is provided an antenna including a dipole antenna, and a parasitic element arranged in parallel to the dipole antenna and having a linear structure and a spiral structure, wherein a directivity and a return loss of the dipole antenna are controlled by setting a distance between the dipole antenna and the parasitic element and a shape and size of the spiral structure.

According to a further embodiment of the invention, there is provided an antenna including a dipole antenna, and a parasitic element arranged in parallel to the dipole antenna and having a linear structure and a folded structure, wherein a directivity and a return loss of the dipole antenna are controlled by setting a distance between the dipole antenna and the parasitic element and a shape and size of the folded structure.

According to the embodiments of the invention, the directivity of the antenna and the return loss can be controlled merely by a dipole antenna and a parasitic element which includes a meander structure, a spiral structure or a folded structure, so that the antenna can be configured planarly or by a single printed wiring board. This can ensure cost reduction.

DETAILED DESCRIPTION OF THE PREFERRED EMBODIMENTS

Preferred embodiments of the present invention will be described below with reference to the accompanying drawings. The description will be given in the following order.

<1. First Embodiment>

<2. Second Embodiment>

<3. Third Embodiment>

4. Fourth Embodiment>

Although the embodiments to be described below are favorable specific examples of the invention to which various technically preferable restrictions are given, it should be understood that the scope of the invention is not limited to those embodiments unless otherwise particularly specified.

<1. First Embodiment>

[Configuration of Antenna]

Figure 2A:
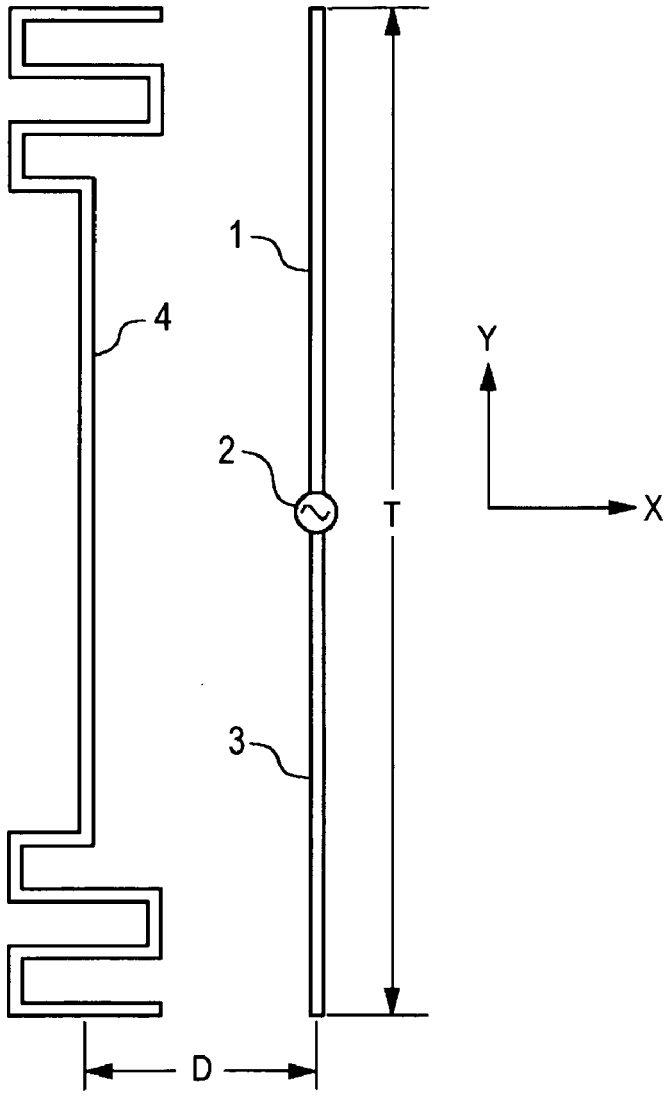
FIGS. 2A and 2B are a side view and a top view of an antenna according to a first embodiment of the invention, respectively.
Figure 2B:
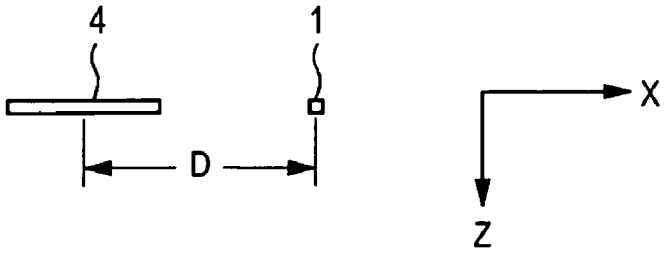

The first embodiment of the invention will be described below referring to FIGS. 2A and 2B. FIG. 2A is a side view, and FIG. 2B is a top view. In the diagrams, the side face is called "(X-Y) plane", and the top face is called "(X-Z) plane". As shown in FIGS. 2A and 2B, a dipole antenna serving as a power feed element includes a dipole antenna (positive port) 1, a dipole antenna (negative port) 3, and a power feed point 2. The total length of the dipole antenna is set to T. One example of T is $\lambda/2$. It is to be noted however that the length may be set to other than $\lambda/2$.

A parasitic element 4 having meander structures at both ends of a linear structure is provided at a location away from the dipole antenna by an arbitrary distance D. The distance D is the distance between the center of the conductor of the dipole antenna and the center of the linear structure portion of the parasitic element 4. The total length of the parasitic element 4 is substantially equal to that of the dipole antenna. The dipole antenna and the parasitic element 4 are realized by, for example, conductive patterns on a printed wiring board. The printed wiring board in use is a double-sided board on which wiring patterns can be formed on both sides thereof.

The parasitic element 4 serves to control the directivity of the dipole antenna having the dipole antenna (positive port) 1, the power feed point 2 and the dipole antenna (negative port) 3. The parasitic element 4 also serves to obtain impedance matching between the dipole antenna, which has the dipole antenna (positive port) 1, the power feed point 2 and the dipole antenna (negative port) 3, and the parasitic element 4.

The directivity of the dipole antenna and the amount of the return loss thereof can be controlled by adjusting the distance D from the dipole antenna to the parasitic element 4 having the meander structure, and the shape and size of the meander structure. The shape and size of the meander structure mean the number of folds, the diameter (width) of the element, the interval between parallel folded portions, the length between both ends of the folded portion, and so forth.

The radiation pattern of only the dipole antenna which serves as the power feed element becomes a circle about the position of the dipole antenna in the (X-Y) plane and the (X-Z) plane, and is non-directional. When a high-frequency current is supplied to the dipole antenna from the power feed point 2, an electromagnetic wave is radiated. The electromagnetic wave from the dipole antenna induces a current in the parasitic element 4. The amplitude and phase of the current are controlled by the distance D, and the shape and size of the meander structure. The electromagnetic wave radiated from the dipole antenna is combined with the electromagnetic wave radiated from the parasitic element 4 to control the directivity.

The parasitic element 4 serves as a reflector or a radiator, and provides a directivity having a shape extruded toward the parasitic element in the horizontal plane. Further, reception of the electromagnetic wave radiated from the parasitic element 4 changes the impedance of the dipole antenna as viewed from the power feed point 2.

[Comparison of Return Loss]

Figure 1A:
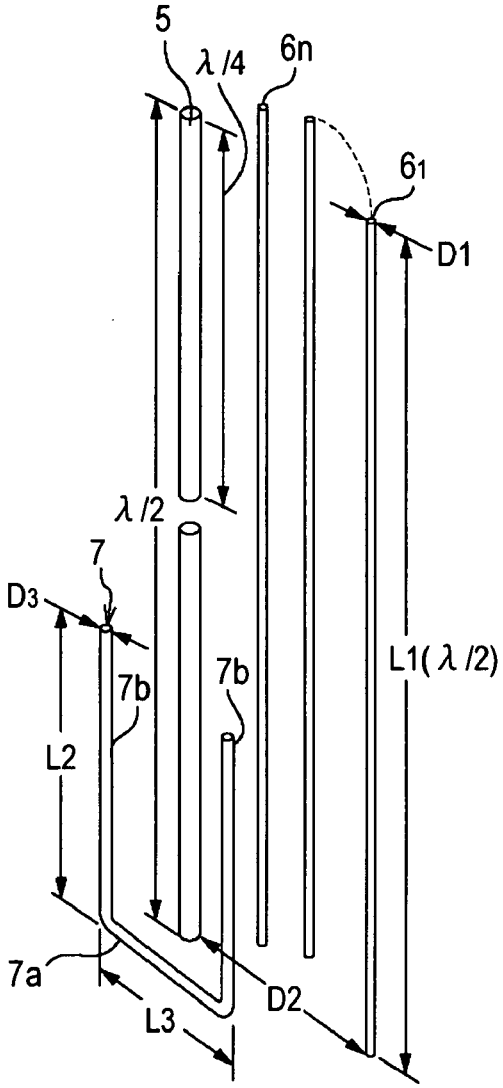
FIGS. 1A and 1B are perspective views showing the configuration of an antenna proposed earlier.
Figure 1B:
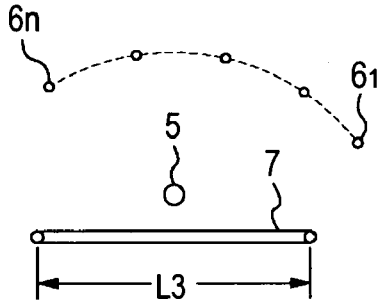
Figure 3A:
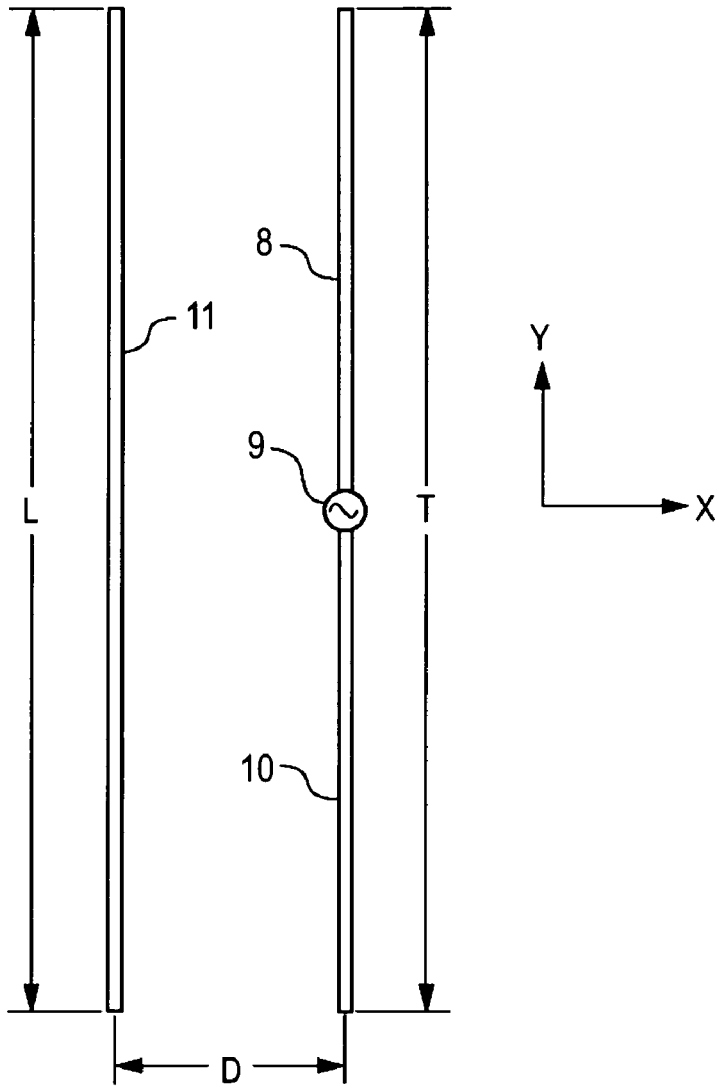
FIGS. 3A and 3B are a side view and a top view of an antenna according to a comparative example of the invention, respectively.
Figure 3B:
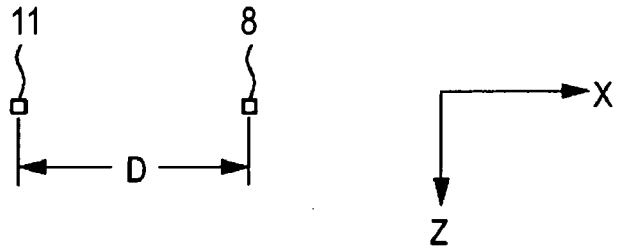

FIGS. 3A and 3B show the configuration of the dipole antenna of the related art described referring to FIGS. 1A and 1B from which the U-shaped parasitic element 7 is removed. FIG. 3A is a side view, and FIG. 3B is a top view. This dipole antenna includes a dipole antenna (positive port) 8, a dipole antenna (negative port) 10, and a power feed point 9. A linear parasitic element 11 is provided at a location away from the dipole antenna by an arbitrary distance D. The dipole antenna including the dipole antenna (positive port) 8, the dipole antenna (negative port) 10, and the power feed point 9 corresponds to the common dipole 5. The linear parasitic element 11 corresponds to one of the linear parasitic elements $\mathbf{6}_1$ to $\mathbf{6}_n$.

Figure 4:
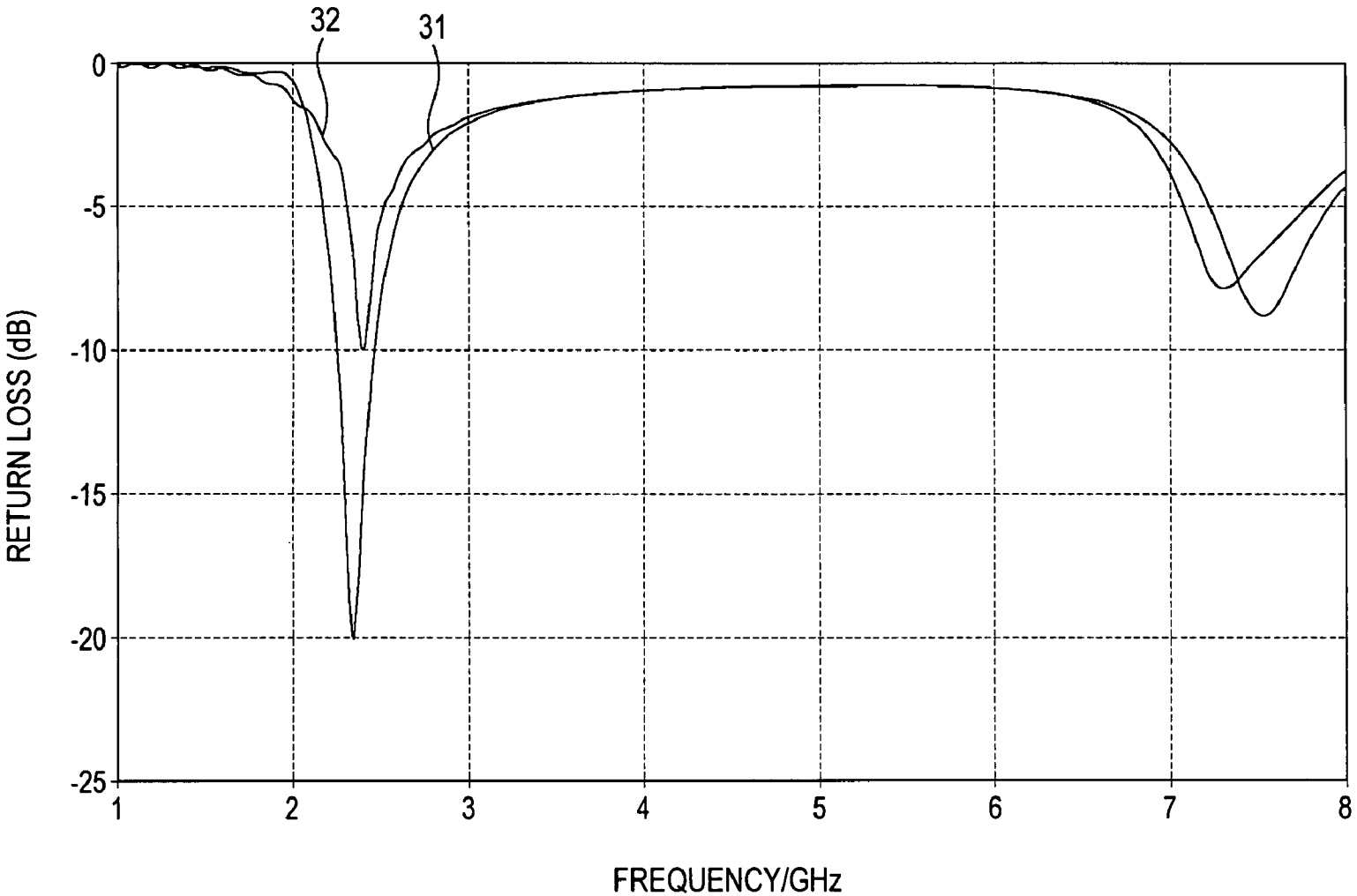
FIG. 4 is a graph showing theoretical values of the return loss.

FIG. 4 shows a return loss 31 according to the first embodiment of the invention shown in FIGS. 2A and 2B in comparison with a return loss 32 of the antenna shown in FIGS. 3A and 3B. The abscissa in FIG. 4 represents the frequency (GHz), and the ordinate represents the return loss (dB) which takes, for example, theoretical values (simulation results). The return loss is the ratio of the input wave to the antenna to the reflected wave. In other words, the return loss indicates how much of the high-frequency signal supplied from the power feed point 2 in FIG. 2A is reflected and returned. A smaller return loss means a smaller reflection loss, and means better impedance matching.

As shown in FIG. 4, the antenna shown in FIGS. 3A and 3B has the return loss reduced at a certain frequency (e.g., 2.4 GHz) due to the removal of the U-shaped parasitic element. The amount of the reduction of the return loss is 10 dB or so. The adoption of the meander structure for the parasitic element as in the first embodiment of the invention (FIGS. 2A and 2B) can swiftly reduce the return loss to 20 dB or so. It is understood from FIG. 4 that the adoption of the meander structure accomplishes impedance matching at this frequency.

[Directivity of First Embodiment]

Figure 5:
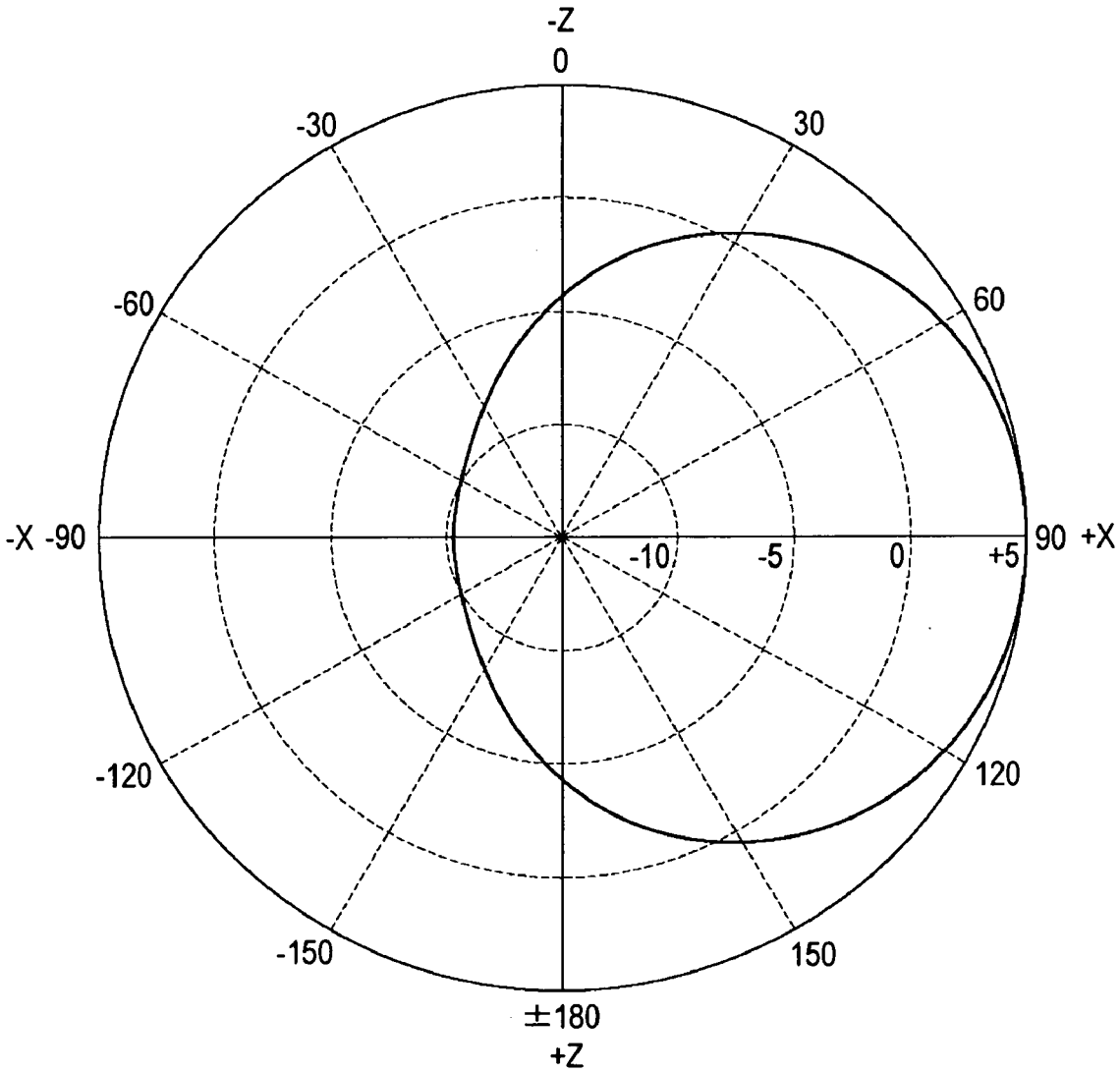
FIG. 5 is an outlined line diagram showing the antenna radiation pattern according to the first embodiment of the invention.
Figure 6:
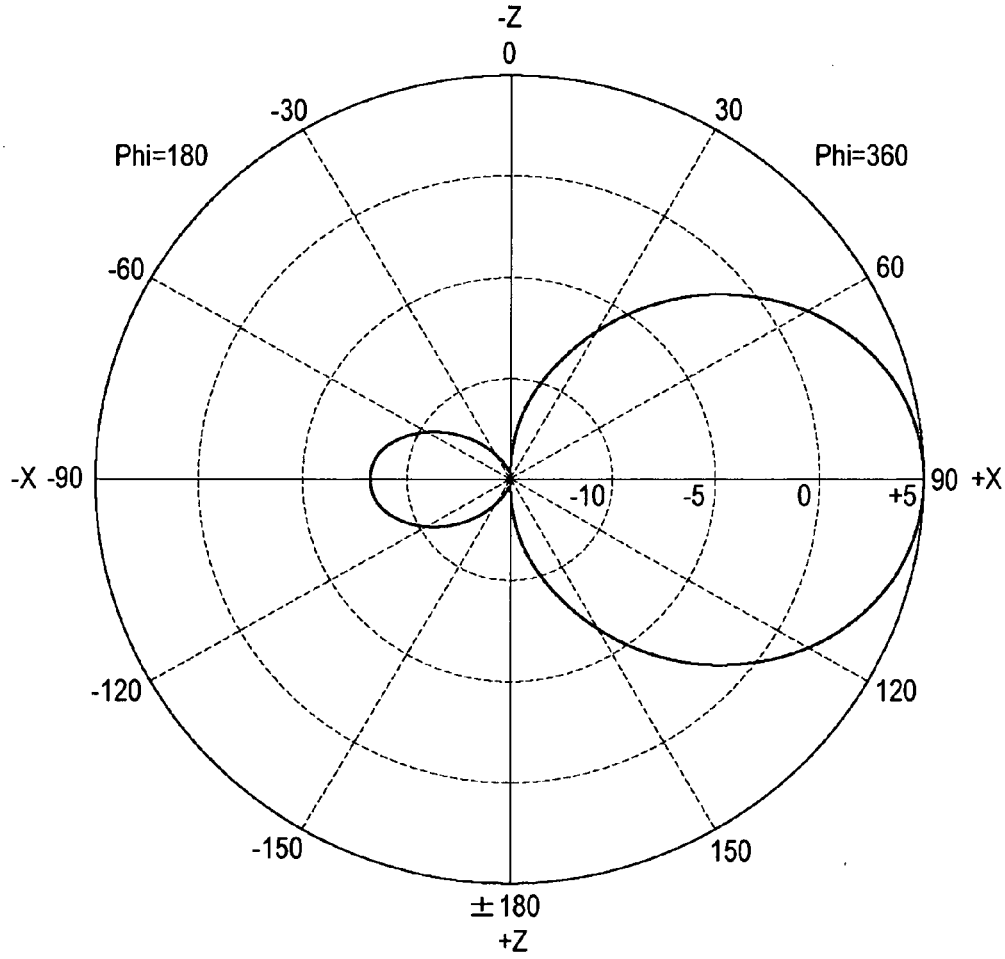
FIG. 6 is an outlined line diagram showing the antenna radiation pattern of the antenna with the configuration shown in FIGS. 3A and 3B.

FIG. 5 shows the radiation pattern of the (X-Z) plane according to the first embodiment of the invention (FIGS. 2A and 2B). FIG. 6 shows the radiation pattern of the same plane of the antenna with the configuration shown in FIGS. 3A and 3B (configured to exclude the U-shaped parasitic element from the related-art antenna described in Patent Document 1). It is apparent from FIG. 5 in comparison with FIG. 6 that the meandering parasitic element 4 according to the first embodiment of the invention is effective in controlling the antenna directivity. It is further apparent from FIG. 5 in comparison with FIG. 6 that the use of the meandering parasitic element 4 can suppress the radiation level toward the meandering parasitic element 4 (−90 degrees). This can also be said to be another effect brought up by the meandering parasitic element 4.

<2. Second Embodiment>

Figure 7:
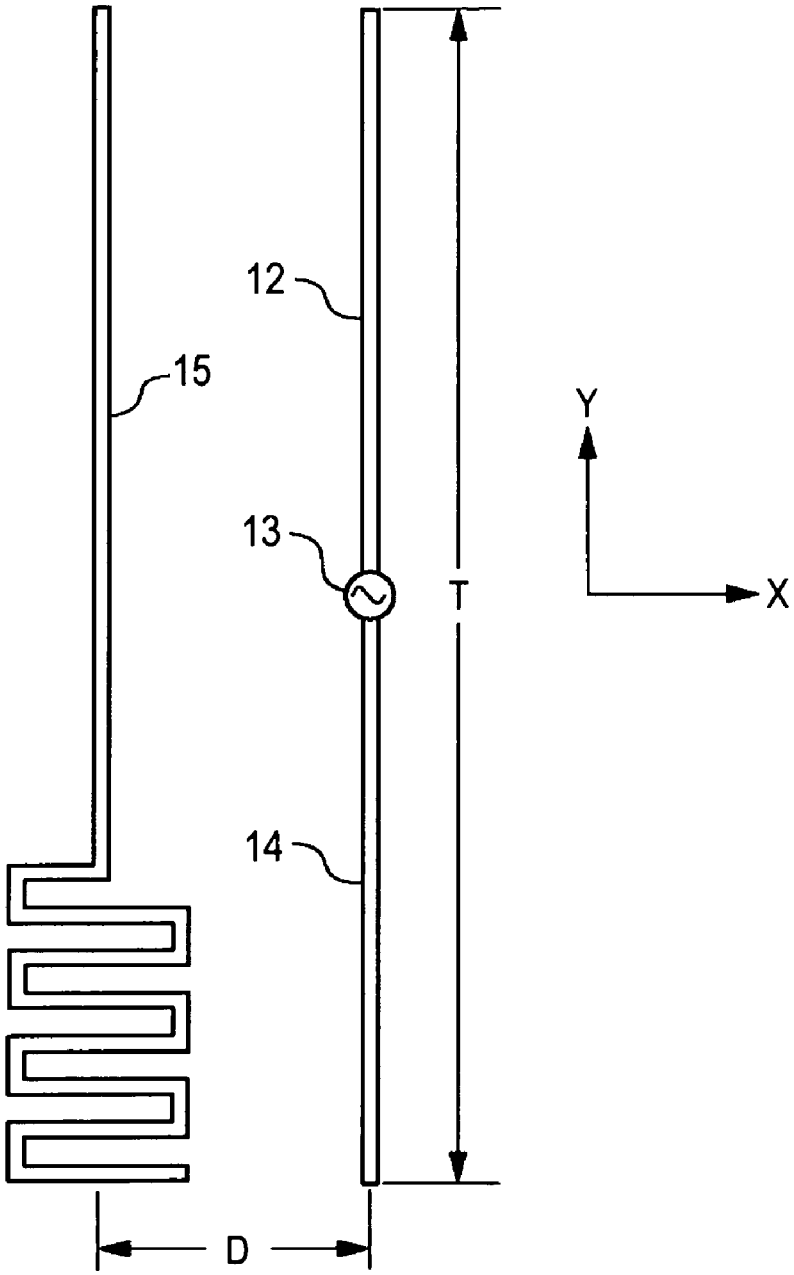
FIG. 7 is a side view of a first example of a second embodiment of the invention.
Figure 8:
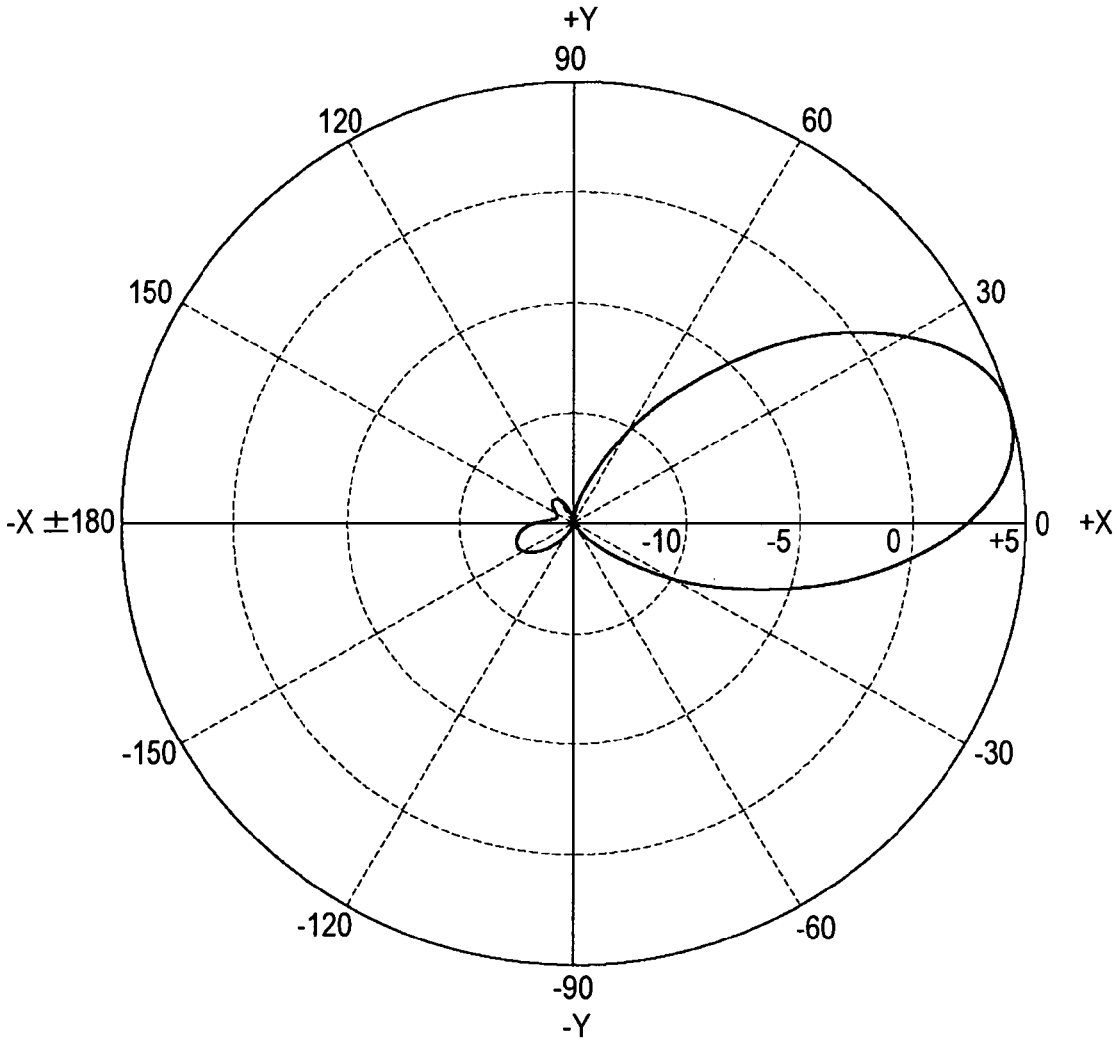
FIG. 8 is an outlined line diagram showing the antenna radiation pattern of the first example of the second embodiment of the invention.

A first example of the second embodiment of the invention will be described below referring to FIGS. 7 and 8. FIG. 7 is a side view of the first example of the second embodiment, and FIG. 8 is a diagram of the antenna radiation pattern of the first example of the second embodiment. A dipole antenna according to the second embodiment includes a dipole antenna (positive port) 12, a dipole antenna (negative port) 14, and a power feed point 13. A meandering parasitic element 15 is provided at a location away from the dipole antenna by an arbitrary distance D. The dipole antenna and the parasitic element 15 are realized by, for example, conductive patterns on a double-sided printed wiring board.

Unlike in the first embodiment, the meander structure is formed concentratedly on the dipole antenna (negative port) 14 side of the linear element that constitutes the parasitic element 15. As shown in FIG. 8, the radiation pattern of the (X-Y) plane is controlled in such a way that the radiation level becomes stronger at the upper portion.

Figure 9:
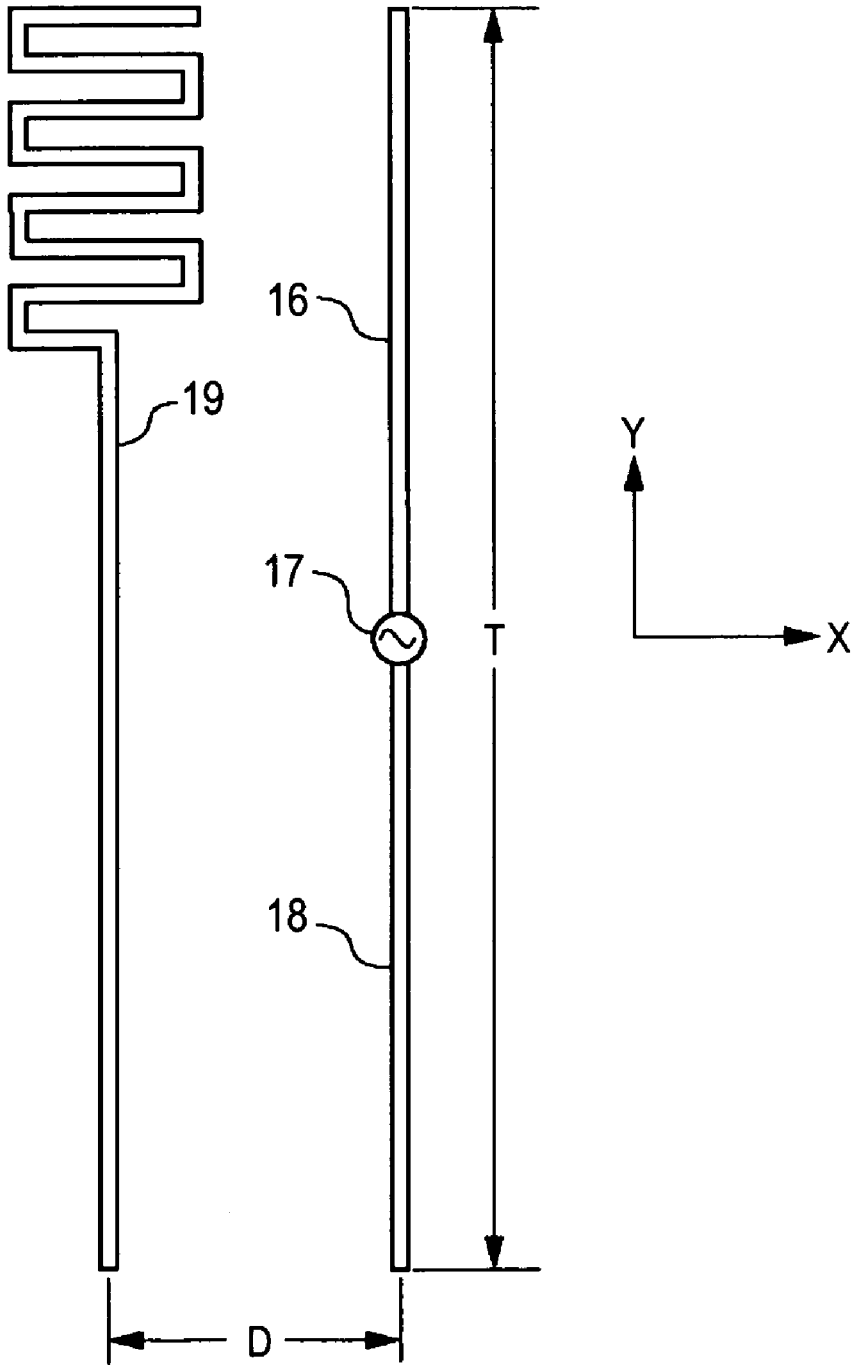
FIG. 9 is a side view of a second example of the second embodiment of the invention.
Figure 10:
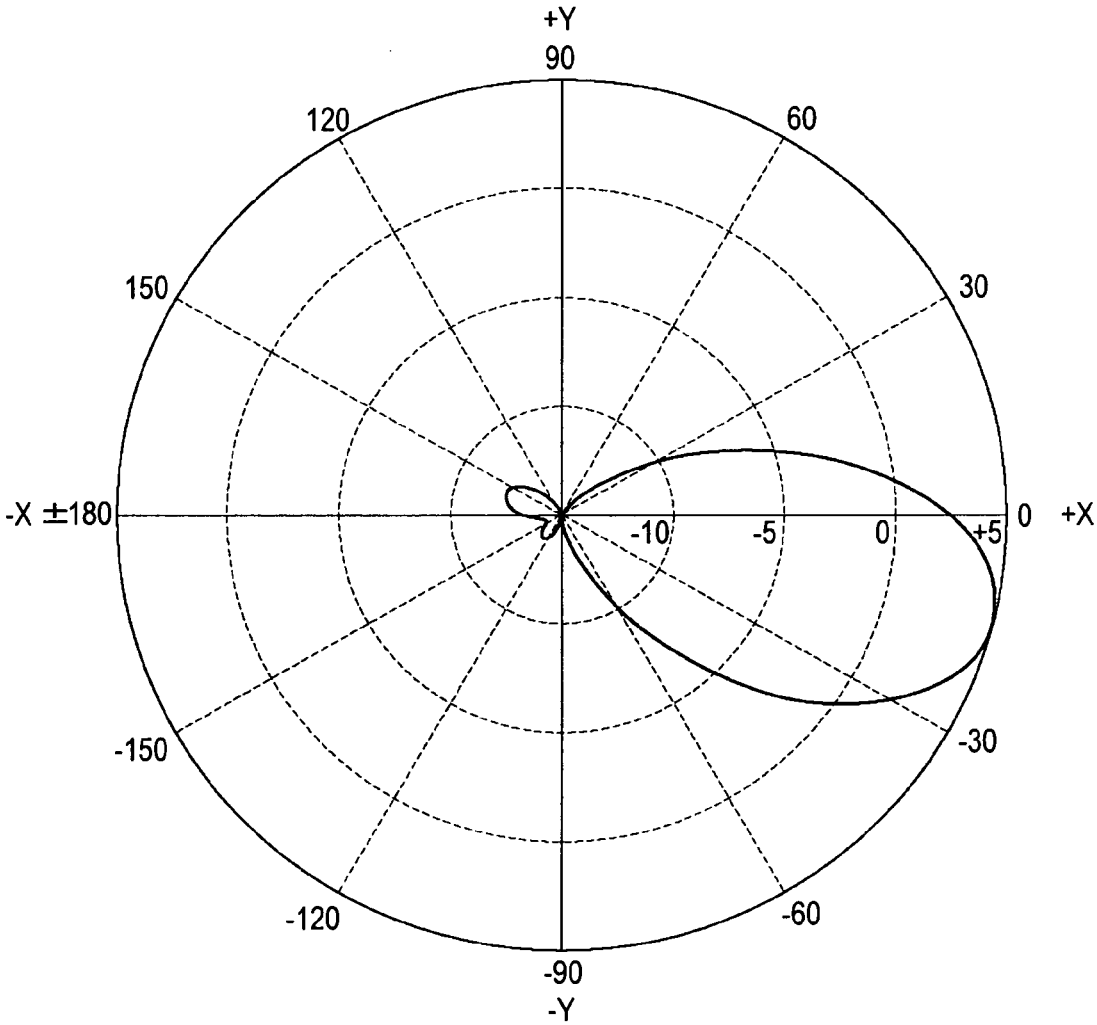
FIG. 10 is an outlined line diagram showing the antenna radiation pattern of the second example of the second embodiment of the invention.

As shown in a side view of FIG. 9, an antenna according to a second example of the second embodiment of the invention includes a dipole antenna which has a dipole antenna (positive port) 16, a dipole antenna (negative port) 18, and a power feed point 17, and a parasitic element 19. The meander structure is formed concentratedly on the dipole antenna (positive port) 16 side of the linear element that constitutes the parasitic element 19. In this example, as shown in FIG. 10, the radiation pattern of the (X-Y) plane is controlled in such a way that the radiation level becomes stronger at the lower portion.

<3. Third Embodiment>

Figure 11A:
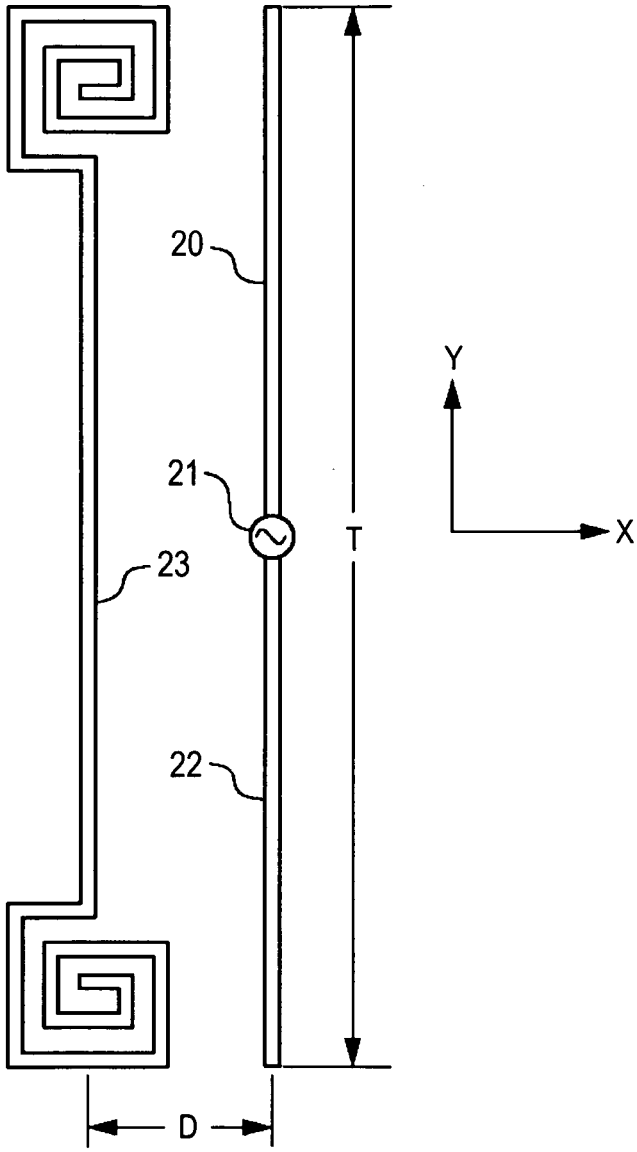
FIGS. 11A and 11B are a side view and a top view of an antenna according to a third embodiment of the invention, respectively.
Figure 11B:
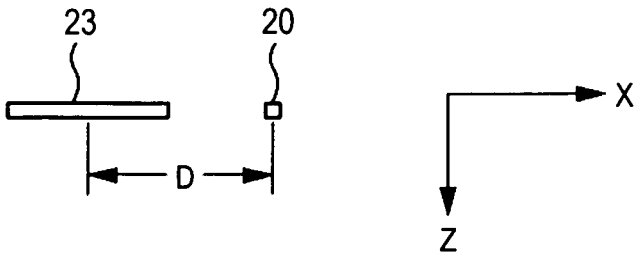

The third embodiment of the invention will be described below referring to FIGS. 11A and 11B. FIG. 11A is a side view, and FIG. 11B is a top view. A dipole antenna according to the third embodiment includes a dipole antenna (positive port) 20, a dipole antenna (negative port) 22, and a power feed point 21. A parasitic element 23 having a spiral structure and a linear structure is provided at a location away from the dipole antenna by an arbitrary distance D. The dipole antenna and the parasitic element 23 are realized by, for example, conductive patterns on a double-sided printed wiring board.

This antenna is configured to control the directivity and the return loss of the dipole antenna by setting the distance D between the dipole antenna and the parasitic element, and the shape and size of the spiral structure. The shape and size of the spiral structure are equivalent to the number of spiral turns, the diameter (width) of the conductor, the interval between conductors, etc. According to the third embodiment, the spiral structure is formed concentratedly on one end side of the linear structure of the parasitic element 23 to enable control of the directivity on the (X-Y) plane, as per the second embodiment.

<4. Fourth Embodiment>

Figure 12A:
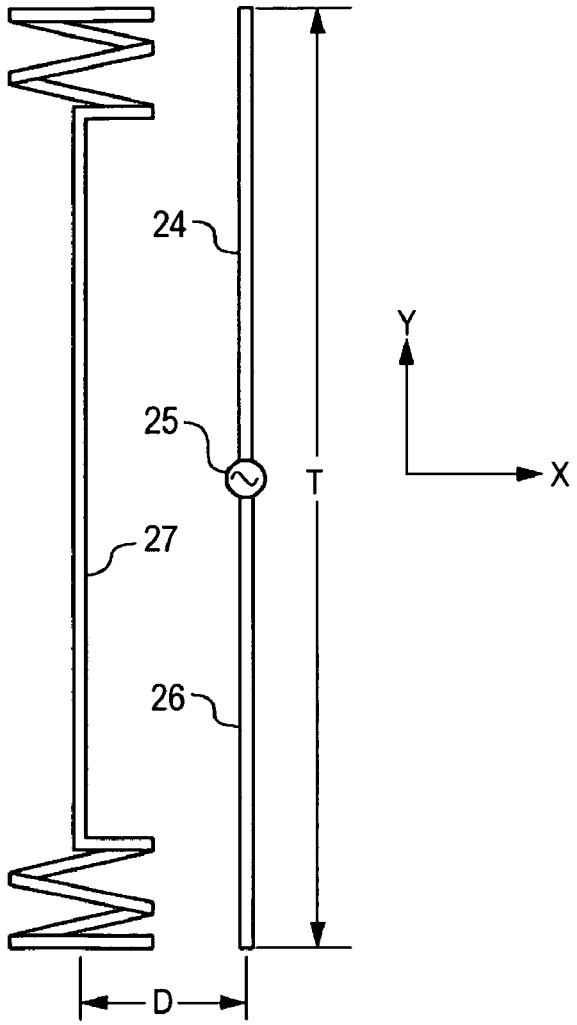
FIGS. 12A, 12B and 12C are a side view, a top view and a perspective view of an antenna according to a fourth embodiment of the invention, respectively.
Figure 12B:
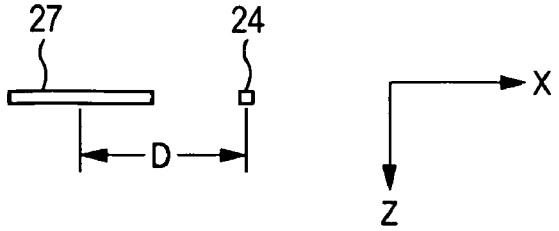
Figure 12C:
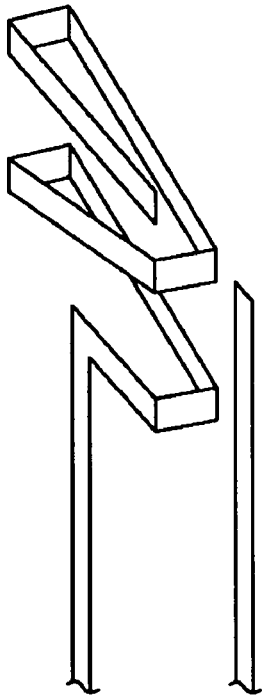

The fourth embodiment of the invention will be described below referring to FIGS. 12A to 12C. FIG. 12A is a side view, FIG. 12B is a top view, and FIG. 12C is a perspective view. A dipole antenna according to the fourth embodiment includes a dipole antenna (positive port) 24, a dipole antenna (negative port) 26, and a power feed point 25. A parasitic element 27 having a polygonal line structure and a linear structure is provided at a location away from the dipole antenna by an arbitrary distance D. The polygonal line structure is a structure changed and folded in the thicknesswise direction, and can be formed by, for example, using both sides of a double-sided board.

This antenna is configured to control the directivity and the return loss of the dipole antenna by setting the distance D between the dipole antenna and the parasitic element, and the shape and size of the spiral structure. The shape and size of the spiral structure are equivalent to the number of spiral turns, the diameter (width) of the conductor, the interval between conductors, etc. According to the fourth embodiment, the folded structure is formed concentratedly on one end side of the linear structure of the parasitic element 27 to enable control of the directivity on the (X-Y) plane, as per the second embodiment.

It is to be noted that the present invention is not limited to the foregoing embodiments, but may be modified in various forms based on the technical concept of the invention. Although the parasitic element has substantially the same length as the length T of the dipole antenna in the foregoing embodiments, such setting is not essential. The length of the dipole antenna is not limited to $\lambda/2$, but may be set to other lengths, such as $\lambda/4$.

It should be understood by those skilled in the art that various modifications, combinations, sub-combinations and alterations may occur depending on design requirements and other factors insofar as they are within the scope of the appended claims or the equivalents thereof.

What is claimed is:

1. An antenna comprising:

a dipole antenna; and a parasitic element arranged in parallel to the dipole antenna and having a linear structure and a meander structure, wherein a directivity and a return loss of the dipole antenna are controlled by setting a distance between the dipole antenna and the parasitic element and a shape and size of the meander structure, wherein the dipole antenna and the parasitic element are formed on a printed wiring board, and wherein the printed wiring board is a double-sided board, and the dipole antenna and the parasitic element are formed using both sides of the printed wiring board.

2. An antenna comprising:

a dipole antenna; and a parasitic element arranged in parallel to the dipole antenna and having a linear structure and a spiral structure, wherein a directivity and a return loss of the dipole antenna are controlled by setting a distance between the dipole antenna and the parasitic element and a shape and size of the spiral structure, wherein the dipole antenna and the parasitic element are formed on a printed wiring board, and wherein the printed wiring board is a double-sided board, and the dipole antenna and the parasitic element are formed using both sides of the printed wiring board.

3. An antenna comprising:

a dipole antenna; and a parasitic element arranged in parallel to the dipole antenna and having a linear structure and a folded structure, wherein a directivity and a return loss of the dipole antenna are controlled by setting a distance between the dipole antenna and the parasitic element and a shape and size of the folded structure, wherein the dipole antenna and the parasitic element are formed on a printed wiring board, and wherein the printed wiring board is a double-sided board, and the dipole antenna and the parasitic element are formed using both sides of the printed wiring board.

4. The antenna according to claims 1, 2 or 3, wherein a directivity in a side surface of the dipole antenna is controlled by a position of formation of the meander structure, the spiral structure or the folded structure with respect to the linear structure of the parasitic element.

* * * * *